US005411268A

United States Patent [19]

Nelson et al.

[11] Patent Number: 5,411,268

[45] Date of Patent: May 2, 1995

[54] GAME OF SKILL AND CHANCE

[75] Inventors: Allan L. Nelson, Torrance; Ron Sarakbi, Huntington Beach; Russell L. Miller, Jr., Laguna Hills, all of Calif.

[73] Assignee: Normandie Casino, Gardena, Calif.

[21] Appl. No.: 301,787

[22] Filed: Sep. 7, 1994

[51] Int. Cl.[6] ..... A63F 1/00

[52] U.S. Cl. ..... 273/292

[58] Field of Search ..... 273/274, 292, 309

[56] References Cited

U.S. PATENT DOCUMENTS

| | | | |
|---|---|---|---|
| 4,659,087 | 4/1987 | Shen | 273/274 |
| 5,265,882 | 11/1993 | Malek | 273/292 |
| 5,280,915 | 1/1994 | Groussman | 273/292 |
| 5,322,295 | 6/1994 | Cabot et al. | 273/274 |

OTHER PUBLICATIONS

WIN Magazine, Apr. 1992 pp. 39–40, 70.

*Primary Examiner*—Benjamin H. Layno

*Attorney, Agent, or Firm*—Bruce A. Jagger; Beehler & Pavitt

[57] ABSTRACT

The game uses a standard 52 card deck, and is played by a minimum of an action player, a banker and a dealer. The dealer, deals the playing pieces, but does not act as the banker. The action player and banker place their wagers before the cards are dealt. The dealer deals 4 cards, each to the player and to the banker. The player, but not the banker, looks at his cards and arranges them in a front hand and a back hand and in any order desired. The front hand is to be played first. The banker's cards are turned over and placed in respective front and back hands. The two front hands are compared to show a win, lose or draw, using the rules of the game of Blackjack. If the action player wins, the banker satisfies the extent of the action player's wager, and that round of play terminates, and the remaining players lose their right to play in that round. Otherwise, play proceeds to the next player. If the action player loses, the amount of his wager is given to the banker. In case of a tie, the two back hands are compared to determine a winner and a loser, using the rules of the game of Poker. If there still exists a tie, the outcome is determined by pre-established rules.

20 Claims, 2 Drawing Sheets

GAME OF SKILL AND CHANCE

BACKGROUND OF THE INVENTION

1. Field of the Invention

The present invention relates to a game of skill and chance and, in particular, to such a game which utilizes the rules of such games as Poker and Blackjack in a wagering environment.

2. Description of Related Art and Other Considerations

To be successful, a game must hold the interest of the players. This means that, for example in a gaming environment as might exist in a casino or club, the players not only should feel that they have a possibility of winning but also have their interest retained aside from monetary concerns.

With respect to the desire for financial gain, when the gaming house is an active player, the odds of winning are biased to a greater or lesser degree in favor of the house, to ensure that the house will show a profit and, therefore, remain in business. This situation often diminishes the enthusiasm of the player. However, if competition were solely between the players, and the house was present solely as a place where the gambling occurred, the odds of winning would be evened amongst the players. That is, from time to time the favorable odds would move from player to player and, therefore, no one player would feel that he or she were at a disadvantage. It is thus important to minimize this concern. Certain governmental authorities also require that this arrangement be used.

The game of Blackjack generally requires very little skill on the part of the player. Most of the results are determined by the luck of the cards that are drawn. Poker, by contrast, requires considerable skill.

With respect to retaining a player's interest, there should generally be something inherent in the game to involve the player, even without regard to financial gain and, sometimes, despite the occurrence of loss. In some cases, it is the thrill of chance, that "lady luck" will smile upon the player. Other times, the player wishes to be the captain of his or her fate, that he or she has, or feels that he or she has the skill to prevail over all opponents, whether human or inanimate, such as in the lay of the cards. It is therefore important that there be aspects of the game which are designed to retain the non-financial interests of a diversity of players.

Previous expedients wherein players separated the cards dealt to them into two hands include, for example, Shen et al U.S. Pat. No. 4,659,087. According to the teachings of this patent each player is dealt four cards which are divided into two hands of two cards each. Both hands in combination are always involved in the outcome of the game and both hands are played under the same rules.

SUMMARY OF THE INVENTION

These and other problems are successfully addressed and overcome by the present Invention by combining both skill and luck. The playing pieces comprise, for example, a standard 52 card deck or a set of tiles which are capable of establishing, singly and in combination, an order of prevalence that enables a selection of one or more of the playing pieces to prevail over another selection of one or more of the playing pieces. There may be as many participants as desired; however, a minimum of two players, in addition to the dealer, is required. The two players are selected, preferably by some random selection method, to function in the roles of an action player and a banker, both being guests or visitors in the gaming house. A third participant, an employee or member of the gaming house, is responsible for controlling and determining the proper play of the game, including dealing and exposing the playing pieces, but generally does not act as the banker or as any other player.

After the playing pieces are dealt to the action player and the banker, these persons arrange and place their pieces in their respective front and back hands. The front hands are first compared to determine a winner and a loser, e.g., using a first set of rules such as, for example, those of Twenty-one or Blackjack. In the event of a tie, the back hands are compared to determine a winner and a loser, e.g., using a second set of rules such as, for example, those of Poker. The first and second sets of rules may, if desired, be the same. The sets of rules may be interchanged so that the first set is applied to the second hands and the second set to the first hands.

In general, well known sets of rules are preferably used. Such well known sets of rules include, for example, those for Blackjack, Poker and Baccarat. Attention is invited to Richard L. Frey, rev., "The New Complete Hoyle Revised" (New York:Doubleday, 1991), 3–14, 513–527, 541–548, which is hereby incorporated herein by refernce, for a detailed discription of various recognized forms of the games of Poker, Blackjack and Baccarat. As will be understood by those skilled in the art other versions of these games and other games may be utilized, if desired, according to the present invention. Further, various governmental regulations may dictate certain variations in the play of various games.

Several advantages are derived from this arrangement. Both skill and luck are used to maintain the players' interest. The gaming house is not an active player, to avoid the abovementioned odds favorite problem and, therefore, to afford equal odds to all players within the rules of a particular game. The gaming house generally is compensated by either a percentage of the pot or a flat fee per hand.

Other aims and advantages, as well as a more complete understanding of the present invention, will appear from the following explanation of exemplary embodiments and the accompanying drawings thereof.

DETAILED DESCRIPTION OF THE PREFERRED EMBODIMENTS

Figure 1:
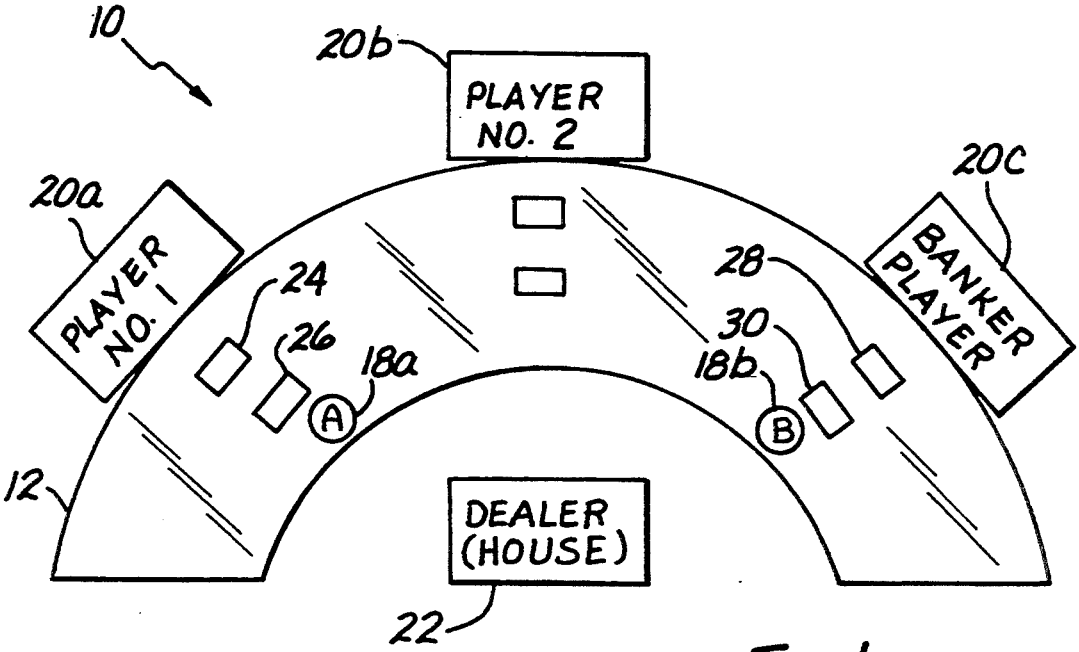
FIG. 1 is a view of a typical set up for playing the game of the present invention.
Figure 3:
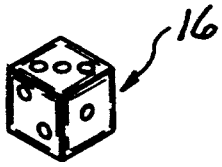
FIGS. 2–4 illustrate examples of playing pieces, markers, and a selection device.
Figure 2:
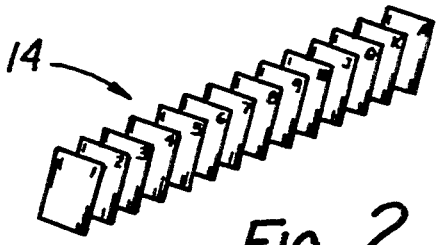
Figure 4:
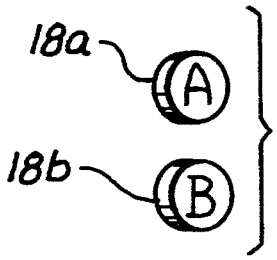

The physical paraphernalia or equipment and articles used in the present invention, as generally illustrated by numeral 10 in FIG. 1, include a gaming table 12 (FIG. 1), playing pieces 14 (FIG. 2), a random selection device 16 (FIG. 3), and markers 18*a* and 18*b* (FIG. 4). As will be understood by those skilled in the art, alternative, supplemental or additional paraphernalia may be utilized within the scope of the invention.

The participants include players whose positions are designated, for example, by indicium 20*a*, 20*b* and 20*c* and a dealer whose position is designated by indicium 22. For purposes of illustrating the present invention, only three players are shown; however, if more players were present, then they would be designated by numerals 20*d*, 20*e*, etc. The dealer is, for example, an employee of the gaming house, and the players are visitors or invitees thereto to play the game.

Playing pieces 14 comprise cards, tiles or any equivalent media which have a display thereon of numbers, letters, designs and the like that are capable of establishing an order of prevalence for enabling play of the game. The order of prevalence may comprise a single one or a combination of playing pieces whose total or aggregate enables a set of one or more playing pieces to prevail over another set of one or more of the playing pieces. Most commonly, the display utilizes numbers respectively valued from 2–10, aces valued at 1 or 11, and pieces with depictions thereon (e.g., king, queen and jack) valued at 10 each. Wild cards may be used as are conventional in such games as Poker.

Two markers 18*a* and 18*b* , such as buttons, comprising an action button (having letter "A" thereon) and a banker button (having letter "B" thereon), respectively designate the player (an "action player") presently playing the game against the banker.

Selection device 16 may, for example, comprise a die, long and short straws, a random number generator, or any other means which permits suitable random selection to determine which participant is the action player and which is the banker.

The gaming table is suitably shaped, such as, for example, having a horse shoe configuration which is typically found in gaming houses.

There may be as many participants as desired; however, a minimum of two players is required. As described below, one player is designated as the action player, and one as a banker.

The dealer, who is not a player, and may be, for example, a member or employee of the gaming house, is responsible for controlling and determining the proper play of the game. The dealers duties include dealing the playing pieces, but the dealer does not act as the banker and, in fact in some jurisdictions, is prohibited from doing so.

Figure 5:
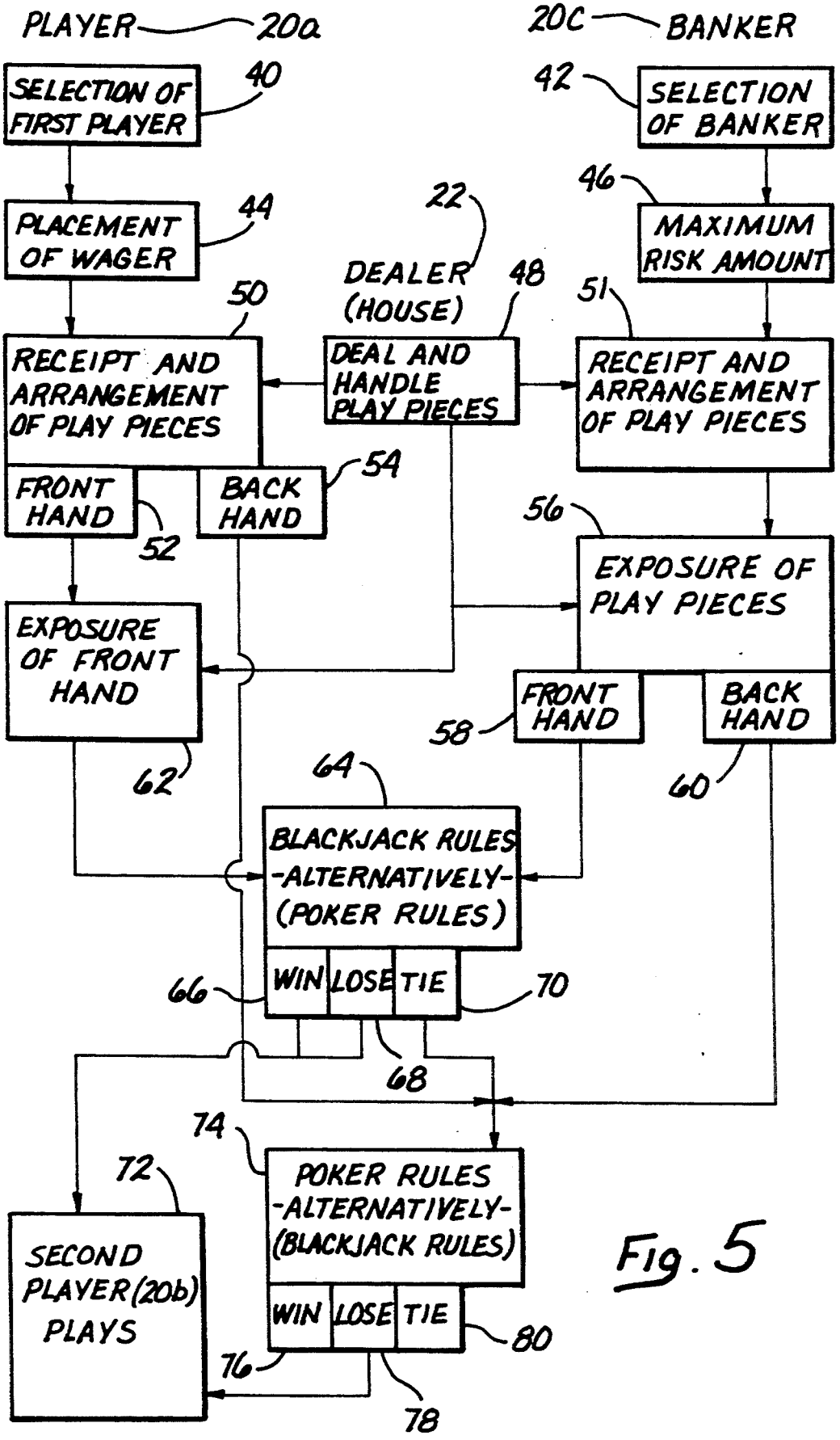
FIG. 5 is a flow diagram depicting a preferred and alternate play of the present invention.

Operation of the game preferably progresses in the order depicted, for example, in FIG. 5 and the boxes or enclosures therein. As an aid in understanding the following exposition, the illustrations in FIG. 5 are arranged in the following manner. Those operations relating to action player 20*a*, and later player 20*b* , are depicted, for example, in the left hand column of FIG. 5. Those operations relating to banker 20*c* are depicted, for example, in the right hand column of FIG. 5. Those operations relating to dealer 22 are depicted, for example, in the center column of FIG. 5. Also shown in the center column are conditions of win, lose and tie.

Before play of the game commences, preferably the banker and the action player are chosen (enclosures 40 and 42), preferably by use of random selection device 16. The selection device is actuated (for example, the die is rolled by the players, or the straws are drawn by the players, or the random number generator is activated), to determine who will be the first player, that is, the action player (enclosure 40). Action marker or button 18*a* is placed before that player.

Preferably, the selection device is also actuated to determine which of the players will act as the banker (enclosure 42). The banker marker or button 18*b* is preferably placed before the banker-player. However, even though the selection device designates a player to be the banker, that player has the right to decline to be the banker. That player, who agrees to become the banker, performs that function preferably for a predetermined set number of plays; thereafter, the position of banker rotates around the table to subsequent players in a predetermined manner. The number of plays and the manner of rotation of the banker may be agreed upon by the players or may be predetermined by house rule. The location of the action player button 18*a* determines which player will play against the banker first. The action then rotates from that first player to the next player according to a predetermined order of rotation. Because the maximum amount which the banker can lose on any one round of play is determined by the amount which the banker initially wagers at the start of that round, not all players will necessarily get to play in any given round.

Preferably, a wager (enclosure 44) is placed by all players before the playing pieces, for example, the cards or tiles, are dealt. Alternatively, the banker may not place his wager until after he has examined the set of playing pieces which he has been dealt. Preferably, the banker (enclosure 46) also selects an amount of money or chips which he is willing to risk losing, and places this amount before him as his wager, before the playing pieces are dealt.

The house dealer deals (enclosure 48) four cards or tiles face down to each player (enclosure 50) and to the banker (enclosure 51). If desired, for example, more or less than four playing pieces may be dealt and one or more playing pieces may be placed face up, as previously set, for example, by house rule or by player agreement. According to the preferred embodiment, four playing pieces make up one set and they are all dealt fasce down. Banker marker/button 18*b* is placed on the banker's playing pieces.

The sets of playing pieces may be dealt one at a time in rotation so that each player receives one piece before any player receives a second piece. Alternatively, all of the pieces in one player's set may be dealt to him before any pieces are dealt to the next player. Other variations may be used if desired.

Each player, but preferably not the banker, looks at his playing pieces. The players arrange their own pieces and generally place them (enclosure 50) into two piles. Generally, although not necessarily, the players may elect to divide their pieces into two piles, one of which is designated a front or first hand 24 (enclosure 52) and the other a back or second hand 26 (enclosure 54). For convenience these playing pieces will be referred to from time to time herein as "cards" which will be understood by those skilled in the art to include cards, tiles, and the like.

Some considerable degree of skill is required in arranging these cards between the front and back hands. The front hands for both the action player, and later, the banker are to be played first, according to a first set of rules which may, for example, be those of Blackjack or Twenty-one. When the order of prevalence for the front hand is determined, for example, by the conventional rules of Blackjack the limit is 21 and the objective is to get as close to 21 as possible without going over 21. In establishing the front hand a player may use one, or as many of the cards dealt as the player chooses, for the front hand Since the player is setting the front hand it will not go over 21 The rest are placed in the back hand The total of 21 points is generally selected as the limit for the front hand simply because this is the limit placed by the conventional game of Twenty-one or Blackjack. However, any other numerical limit may be chosen, it being understood that the present invention is not to be limited to the particular total of 21 points or to the use of Blackjack rules for the front hand.

Preferably, after all of the players, except the banker, have made their selections of playing pieces between the front and rear hands, the dealer then turns over all the banker's playing pieces (enclosure 56). The banker preferably selects from the face up playing pieces, in full view of the other players, which playing pieces he wishes to place in a front hand 28 (enclosure 58) and in a back hand 30 (enclosure 60). As for each player, the banker's front playing pieces can comprise one or more of the pieces dealt to him, as he chooses. Other than selecting which playing pieces to put in which hand the players and the banker preferably do not touch their playing pieces.

The house dealer then turns to the player with the action button before him, in this example player 20*a*, and turns over the playing pieces in that player's front hand 24 (enclosure 62). This shows (enclosure 64) a win (enclosure 66), lose (enclosure 68) or draw (enclosure 70) vis-a-vis the banker's playing pieces in his front hand 28.

If player 20*a* wins, the banker (or the dealer) gives an amount of money or chips from the total before him to satisfy the extent of the wager of that action player. If the amount before the banker is insufficient to satisfy the action player's winnings, then the banker gives all he has to the action player and this round of play is concluded. Preferably, no additional amount is owed by the banker beyond what he placed on the table at the start of play. If the banker has no more funds on the table before him, that round of play terminates, and the remaining players, for example, player 20*b* , lose their right to play in that round. The remaining players keep their wagers. If money or chips are left before the banker after the action player is satisfied, play then proceeds (enclosure 72) to the next player, here, player 20*b* . The action button may be moved to the next player as play progresses, or not, as the predetermined rules may provide.

If the action player (in the example presented, player 20*a* ) loses, he gives the amount of his wager to the banker.

If there is a tie (enclosure 70), the dealer turns over back hand 26 of the action player (player 20*a* ). Using the rules of the game of Poker, the cards are examined (enclosure 74) to provide a winner (enclosure 76) and a loser (enclosure 78). If there still exists a tie (enclosure 80), then the outcome is determined by the dealer according to predefined rules. Preferably, banker is declared the winner, simply as a matter of moving play to other players, before they tire of waiting. It is to be understood, however, that, either by player agreement or by house rules, the action player may be declared the winner in case of the last-mentioned tie, or additional rules of play may be utilized if desired. Thereafter, play moves onto the next player (enclosure 72) if the banker still has some part of his wager before him.

In the preceding illustration of play, Blackjack rules are employed to regulate the front hand, and Poker rules the back hand. It is to be further understood that, although the use of the rules of Poker and Blackjack or Twenty-one are the preferred gaming rules used with the present invention, other rules of prevalence may be employed with equivalent results to determine winners and losers, or who shall prevail in the event of a draw or a tie.

The round continues until all players have played, or the banker becomes bankrupt. The next round proceeds with the same or a new banker, as previously established.

As an alternate to the above play, as indicated by the parenthetical wording in enclosures 64 and 74, Poker rules may be used to determine the party who prevails during the front hand play, and Blackjack rules may be used to determine the party who prevails during the back hand play.

From the foregoing description, it is obvious that both luck and skill are combined as important features in the present invention. Luck resides in the cards which are dealt to the participants. Skill is present in the arrangement of the playing pieces between the front and the back hands. Experience has determined that a tie occurs more than 50 percent of the time; therefore, skill becomes an important factor. For example, if a participant's four cards comprise an ace, a king, a queen and an "8", the better play is to place the ace and the queen in the front hand, as totalling 21 points, and the king and "8" in the back hand. The king in the back hand might be a critical card and, as having a higher Poker value than the queen. As another example, if the four cards comprise an "8", a "3", a "7" and a jack, it may be better to place the "8", the "3" and the jack in the front hand, which total Twenty-one points, as a better possibility of winning, despite the fact that the "7" will be in the back hand. However, the participant might wish to utilize a different combination of the "8", the "3" and the "7" for a total of 18 points, so as to leave the higher value jack in the back hand. These examples are evidence that the game of the present invention involves considerable skill and judgement, and not simply the so called luck of the cards.

As will be understood by those skilled in the art, alternative, supplemental or additional steps and operations may be utilized within the scope of the invention.

Although the invention has been described with respect to particular embodiments thereof, it should be realized that various changes and modifications may be made therein without departing from the spirit and scope of the invention.

What is claimed is:

1. A method of playing a game of skill and chance, comprising the steps of:

utilizing playing pieces, singly and in combination, which are capable of establishing an order of prevalence that enables a selection of one or more of the playing pieces to prevail over another selection of one or more of the playing pieces;

furnishing a first randomly selected set of a predetermined quantity of the playing pieces to a first player whose responsibility is to separate the first set into first and second hands comprising subsets of the pieces;

furnishing at least a second randomly selected set of the playing pieces, in the same quantity as that furnished to the first player, to at least a second player whose responsibility is to separate the second set into first and second hands comprising subsets of the pieces;

comparing the first hands of the players to determine an order of prevalence or a tie therebetween and thereby to determine if there is a winner and loser or a tie between the two;

in the event one of said first hands prevails over an other of said first hands, the player with the prevailing first hand wins and the second hand of the losing player is disregarded;

in the event of a tie, comparing the second hands of the players to determine an order of prevalence or a tie therebetween and thereby to determine if there is a winner and loser or a tie between the players; and in the event of a tie between the second hands, determining the outcome according to a predetermined rule.

2. A method according to claim 1 including utilizing first predetermined rules to compare the first hands, and utilizing second predetermined rules to compare the second hands.

3. A method according to claim 2 wherein the rules utilized to compare the first hands are the same as the rules utilized to compare the second hands.

4. A method according to claim 2 wherein the rules utilized to compare the first hands are different from the rules utilized to compare the second hands.

5. A method according to claim 2 wherein the rules of Blackjack are utilized to compare at least one of the first or second hands.

6. A method according to claim 2 wherein the rules of Poker are utilized to compare at least one of the first or second hands.

7. A method according to claim 2 wherein the rules of Baccarat are utilized to compare at least one of the first or second hands.

8. A method according to claim 1 wherein said step of comparing the first hands comprises the step of using the rules of Blackjack to determine the order of prevalence therebetween, and said step of comparing the second hands comprises the step of using the rules of Poker to determine the order of prevalence therebetween.

9. A method according to claim 1 wherein said step of comparing the first hands comprises the step of using the rules of Poker to determine the order of prevalence therebetween, and said step of comparing the second hands comprises the step of using the rules of Blackjack to determine the order of prevalence therebetween.

10. A method according to claim 1 wherein said furnishing steps respectively comprise the step of so furnishing the playing pieces that at least some are initially viewable only by the player to whom they are furnished and, therefore, hidden from the other players.

11. A method according to claim 1 wherein playing pieces comprise at least one 52 card deck of standard Poker playing cards.

12. A method according to claim 1 including furnishing at least a third randomly selected set of the playing pieces, in the same quantity as that furnished to the first player, to at least a third player whose responsibility is to separate at least the third hand into first and second hands comprising subsets of the pieces.

13. A method according to claim 1 including furnishing a plurality of randomly selected sets of the playing pieces to a plurality of additional players.

14. A method according to claim 1 including furnishing said randomly selected sets one playing piece at a time in rotation, whereby all players receive a first playing piece before any player receives a second playing piece.

15. A method according to claim 1 including furnishing said randomly selected sets more than one playing piece at a time, whereby the first player receives more than one playing piece before the second player receives any playing pieces.

16. A method according to claim 1 wherein said furnishing steps respectively comprise the step of so furnishing the playing pieces that at least some are initially viewable by all of the players.

17. A method according to claim 1, requiring a minimum of three persons, further comprising the steps of:

naming one of the persons as the provider of said furnishing steps, and the remaining persons as players;

selecting a first of the remaining persons as the first player; and selecting a remaining person as the second player.

18. A method according to claim 17 wherein said provider furnishes at least some of said playing pieces so they are initially viewable only to the person to whom they are furnished, and the provider exposes at least some of such hidden playing pieces for at least one of the players after the playing pieces have been separated by the players into first and second hands.

19. A method according to claim 17 wherein at least one of said selecting steps comprises the step of utilizing a random selection method.

20. A method of playing a game of skill and chance utilizing a first set of rules to determine the initial outcome and a second set of rules to determine the outcome in the event the initial outcome is a tie, requiring a minimum of four persons, comprising the steps of:

utilizing playing pieces which are capable of establishing an order of prevalence singly and in combination whose aggregate enables a set of one or more of the playing pieces to prevail over another set of one or more of the playing pieces under the first and second sets of rules;

naming one of the persons as dealer of the playing pieces, and the remaining persons as players from whom one will be selected as an action player and another as a banker;

selecting an action player and a banker from the remaining persons;

placing wagers respectively by the players, including the banker, the banker placing wager step being limited by the banker to a maximum amount of wager which he is willing to risk;

the dealer furnishing randomly selected sets of a predetermined quantity of the playing pieces to each of the players whose responsibility is to separate the first sets of playing pieces into first and second hands comprising subsets of the first sets of the playing pieces, at least some of said playing pieces in each set being initially viewable only by the player to whom that set was furnished and thereby hidden from all other players;

the dealer exposing all hidden playing pieces in the hands of the banker and, exposing all hidden playing pieces in at least the first hand of the action player;

using the first set of rules, comparing the first hands of the banker and the action player to determine an order of prevalence or a tie between the first hands and thereby to determine if there is a winner and loser or a tie between the two;

in the event that the banker's first hand prevails against the action player's first hand, giving the amount of the action player's wager to the banker, at which time, the second hand of the action player is disregarded and play passes to a subsequent player;

in the event that the action player's first hand prevails against the banker's first hand, giving an amount, equal to the amount of the action player's wager but not exceeding the maximum amount of the banker's wager, from the banker's wager to the action player, at which time, play passes to a subsequent player, provided the maximum amount of the banker's wager has not been reached; and in the event of a tie, the dealer exposing the hidden playing pieces in the second hand of the action player and, using the second set of rules, comparing the second hands of the action player and the banker to determine an order of prevalence between the second hands and thereby to determine if there is a winner and loser or a tie between the two;

in the event of a tie between the second hands, the dealer declaring the outcome according to predetermined rules, and distributing the amount of the banker and action player's wagers accordingly and, at which time, play passes to a subsequent player, provided the maximum amount of the banker's wager has not been reached; and the dealer terminating play when all of the players have played to the determination of an outcome or the maximum amount of the banker's wager has been reached.

* * * * *